US009723966B2

(12) United States Patent
Hite et al.

(10) Patent No.: US 9,723,966 B2
(45) Date of Patent: Aug. 8, 2017

(54) HOME APPLIANCE WITH A WATER INLET SYSTEM AND METHOD OF OPERATING HOME APPLIANCE

(71) Applicants: BSH Home Appliances Corporation, Irvine, CA (US); BSH Hausgeräte GmbH, Munich (DE)

(72) Inventors: David Hite, New Bern, NC (US); Michael Justis, New Bern, NC (US); Stefan Kasbauer, Dillingen (DE); Jakob Schultz, Dilligen (DE)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 62 days.

(21) Appl. No.: 14/723,485

(22) Filed: May 28, 2015

(65) Prior Publication Data

US 2016/0345799 A1 Dec. 1, 2016

(51) Int. Cl.

| | |
|---|---|
| ***A47L 15/42*** | (2006.01) |
| ***D06F 39/08*** | (2006.01) |
| ***A47L 15/00*** | (2006.01) |
| ***E03B 7/07*** | (2006.01) |

(52) U.S. Cl.

CPC ..... *A47L 15/4217* (2013.01); *A47L 15/0023* (2013.01); *A47L 15/0097* (2013.01); *D06F 39/08* (2013.01); *D06F 39/088* (2013.01); *E03B 7/074* (2013.01)

(58) Field of Classification Search

CPC ..... A47L 15/0023; A47L 15/0097; A47L 15/483; A47L 15/4217; A47L 15/4244; D06F 39/008; D06F 39/088; D06F 39/08; E03B 7/074

See application file for complete search history.

(56) References Cited

U.S. PATENT DOCUMENTS

| | | | | |
|---|---|---|---|---|
| 2,900,080 | A | 8/1959 | Raczynski et al. | |
| 3,954,116 | A | 5/1976 | Guth et al. | |
| 6,349,731 | B1 * | 2/2002 | Schaaf | A47L 15/4217 134/114 |
| 6,571,965 | B1 | 6/2003 | Beck et al. | |
| D481,179 | S | 10/2003 | Wendt et al. | |
| 6,848,585 | B2 | 2/2005 | VanLandingham | |
| 7,231,929 | B2 | 6/2007 | Landsiedel et al. | |
| 8,082,678 | B2 | 12/2011 | Paruzzolo et al. | |
| 8,555,676 | B2 | 10/2013 | Beck et al. | |

(Continued)

FOREIGN PATENT DOCUMENTS

| | | | |
|---|---|---|---|
| DE | 3418203 | A1 | 11/1985 |
| DE | 102007023020 | B3 | 5/2008 |

(Continued)

*Primary Examiner* — Saeed T Chaudhry

(74) *Attorney, Agent, or Firm* — Michael E. Tschupp; Andre Pallapies

(57) ABSTRACT

A household appliance includes a water inlet configured to connect the appliance to an external water supply; a pressure control device configured to prevent water entering the appliance from the water inlet from exceeding atmospheric pressure; a treatment container configured to treat household items with water; and a seal between the pressure control device and the treatment container configured to prevent gas flowing from the treatment container to the pressure control device.

17 Claims, 6 Drawing Sheets

(56) References Cited

U.S. PATENT DOCUMENTS

| | | | | |
|---|---|---|---|---|
| 8,578,741 | B2 | 11/2013 | Gillo et al. | |
| 8,646,620 | B2 | 2/2014 | Klump et al. | |
| 2009/0277481 | A1* | 11/2009 | Haltmayer | A47L 15/4217 134/96.1 |

FOREIGN PATENT DOCUMENTS

| | | | |
|---|---|---|---|
| EP | 0612495 | B1 | 12/1997 |
| JP | H04166125 | A | 6/1992 |
| JP | 2002078660 | A | 3/2002 |

* cited by examiner

HOME APPLIANCE WITH A WATER INLET SYSTEM AND METHOD OF OPERATING HOME APPLIANCE

FIELD OF TECHNOLOGY

The present technology relates to a home appliance with a water inlet system and a method of operating a home appliance. More particularly, the present technology relates to a home appliance with a water inlet system and a method of operating the home appliance with the water inlet system.

BACKGROUND

Water conducting household appliances need to admit water into the interior of the appliance and maintain operating conditions of the interior of the appliance at certain acceptable levels. For example, pressure in the interior of the appliance may have a maximum acceptable level and admitting pressurized water could potentially exceed the maximum acceptable pressure level. In a similar manner, heat generated inside the appliance may cause a pressure increase, e.g., by way of water turning into steam or heating gas in the interior.

BRIEF SUMMARY

In order to avoid excessive pressures, it is desirable to prevent pressure in the interior of the appliance from exceeding acceptable levels. For example, it may be desirable to control or otherwise reduce water inlet pressure to acceptable levels, e.g., to atmospheric pressure. Likewise, it may be desirable to prevent steam or other heated gas in the interior of the appliance from increasing. It is also desirable to achieve these goals in a relatively low cost manner.

One way to control both the water inlet pressure and pressure generated from heated gases is to provide a vent to atmosphere. Such a vent is relatively inexpensive and reliable because no moving parts are required.

However, venting steam or other heated gas may be undesirable to the user of the home appliance because the steam or heated gas could cause damage to surrounding objects or cause other unwanted results.

An aspect of the present technology solves one or more problems of the prior art.

Another aspect of the present technology includes a device and method that prevents water entering an appliance from exceeding a predetermined level and prevents gas from escaping the appliance to the surroundings in an undesirable manner.

Another aspect of the present technology includes a water conducting household appliance comprising: a water inlet; a pressure reducer downstream of and in fluid communication with the water inlet; a water trap downstream of and in fluid communication with the pressure reducer; an expansion device downstream of and in fluid communication with the water trap; a treatment container downstream of and in fluid communication with the expansion device; and a condensation device downstream of and in fluid communication with the expansion device.

In examples, (a) the pressure reducer comprises a chamber with a vent connected to atmosphere; (b) the chamber comprises: a top with a flow passage connected to the water inlet; and a conduit extending downwards from the flow passage to an interior of the chamber, the conduit being smaller than a surrounding portion of the chamber and having an open, unconnected end, wherein the vent is above the open, unconnected end; (c) the water trap is below the open, unconnected end; (d) the condensation device comprises an expansion hose; (e) the expansion hose extends upwards from the expansion device; (f) the water trap forms a lowest portion of the chamber; (g) wherein the chamber is configured so that water entering the chamber from the inlet impinges on a side wall of the chamber at an acute angle before flowing into the water trap; (h) the acute angle is less than or equal to 45°; (i) the acute angle is less than or equal to 15°; (j) the treatment container is configured to wash dishes, (k) the treatment container comprises a rack for the dishes and a spray device to spray the dishes; and/or (l) the water trap comprises a water trap inlet, a water trap outlet and an intermediate flow passage and the water trap inlet and the water trap outlet are higher than the intermediate flow passage such that when water flows through the water trap a predetermined amount of water remains in the water trap to fill the intermediate flow passage and prevent gas from flowing through the water trap.

Another aspect of the present technology includes a household dishwasher comprising: a water inlet configured to connect the dishwasher to an external water supply; a pressure control device configured to prevent water entering the dishwasher from the water inlet from exceeding atmospheric pressure; a dish washing chamber configured to wash dishes; and a seal between the pressure control device and the dish washing chamber configured to prevent gas from flowing from the dish washing chamber to the pressure control device.

In examples, (a) the seal is a water trap in fluid communication between the pressure control device and the dish washing chamber; (b) the water trap comprises a water trap inlet, a water trap outlet and an intermediate flow passage and the water trap inlet and the water trap outlet are higher than the intermediate flow passage such that when water flows through the water trap a predetermined amount of water remains in the water trap to fill the intermediate flow passage and prevent gas from flowing through the water trap; (c) the pressure control device comprises a vent to atmosphere; (d) the seal is configured to prevent steam in the dish washing chamber from passing through the vent to atmosphere; (e) the pressure control device comprises a chamber with an opening connected to the water inlet and with a fluid connection to the seal; (f) the chamber comprises a wall that forms an acute angle with a central axis of the opening; (g) the opening is formed on an end of a tube extending into the chamber; (h) the tube extends from a top interior wall of the chamber; (i) the vent to atmosphere comprises a second opening in the chamber that is located above the opening; and/or (j) the pressure control device is configured to fluidly connect water in the pressure control device to atmospheric conditions surrounding the household dishwasher but prevent liquid water from passing through the vent to atmosphere.

Another aspect of the present technology includes a method of operating a water conducting household appliance, the method comprising: adding water to the appliance from a household water supply connected to the appliance; fluidly connecting the water to atmospheric conditions surrounding the appliance to control pressure of the water to be equal to atmospheric pressure while the water is added to the appliance; trapping a predetermined amount of the water; maintaining a connection between the predetermined amount of water and the atmospheric conditions; and using the predetermined amount of the water to prevent steam generated in the appliance from escaping the appliance to the surrounding atmosphere through the connection.

Another aspect of the present technology includes a household appliance comprising: a water inlet configured to connect the appliance to an external water supply; a pressure control device configured to prevent water entering the appliance from the water inlet from exceeding atmospheric pressure; a treatment container configured to treat household items with water; and a seal between the pressure control device and the treatment container configured to prevent gas flowing from the treatment container to the pressure control device.

Other aspects, features, and advantages of this technology will become apparent from the following detailed description when taken in conjunction with the accompanying drawings, which are a part of this disclosure and which illustrate, by way of example, principles of this technology.

DETAILED DESCRIPTION

The following description is provided in relation to several examples which may share common characteristics and features. It is to be understood that one or more features of any one example may be combinable with one or more features of the other examples. In addition, any single feature or combination of features in any of the examples may constitute additional examples.

Throughout this disclosure, terms such as first, second, etc. may be used. However, these terms are not intended to be limiting or indicative of a specific order, but instead are used to distinguish similarly described features from one another, unless expressly noted otherwise. Terms such as substantially and about are intended to allow for variances to account for manufacturing tolerances, measurement tolerances, or variations from ideal values that would be accepted by those skilled in the art.

Throughout this disclosure, the terms left side and right side are used. These terms are only intended to provide relational orientation with respect to one another. Any two opposed sides can be a right side and a left side and by changing to an opposed viewpoint, right versus left will be changed. Thus, right side and left side should not be considered limiting and are used only to distinguish their relationship to one another.

Figure 1:
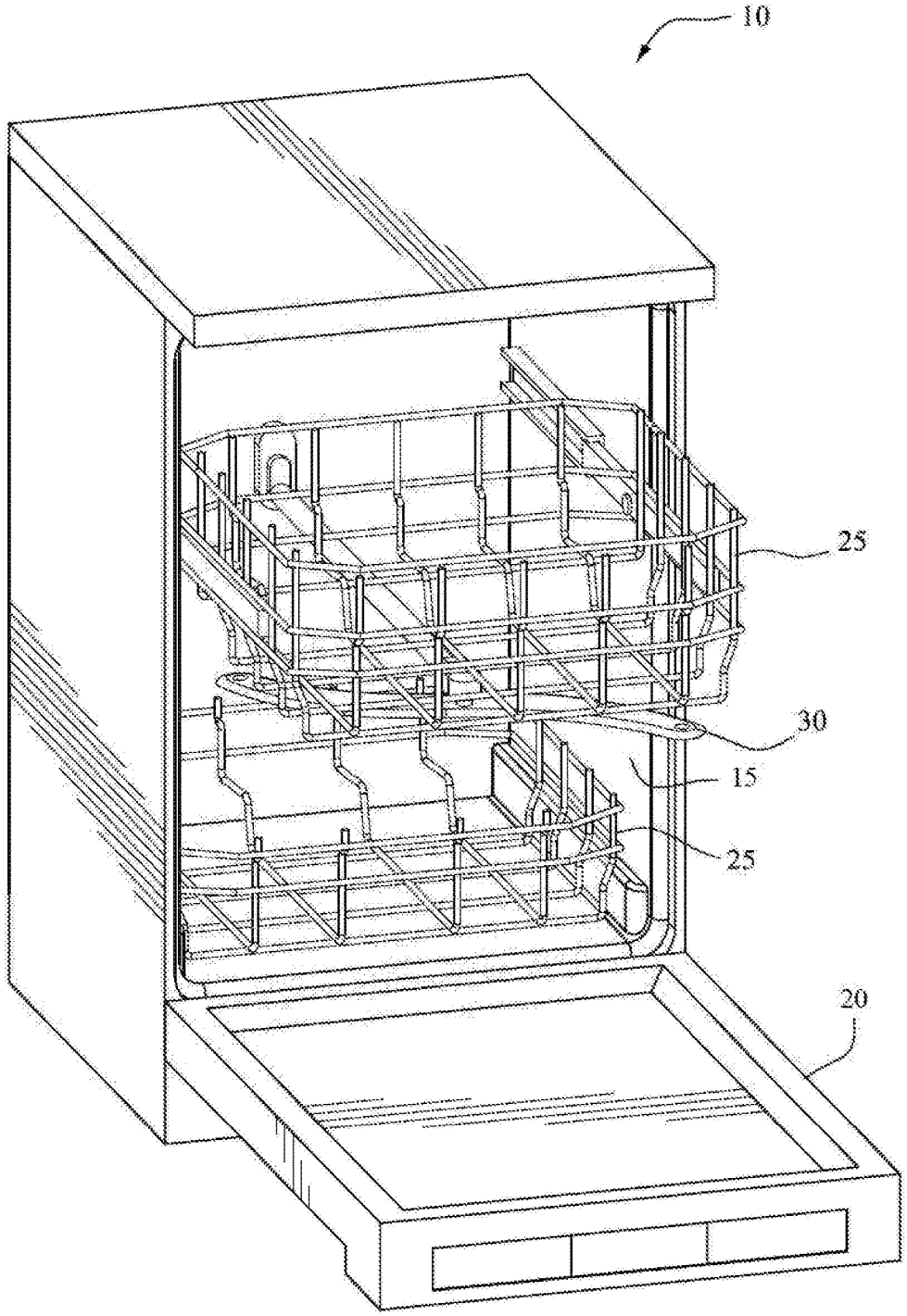
FIG. 1 is a perspective view of a water conducting household appliance.

FIG. 1 illustrates a water conducting household appliance (e.g., a dishwasher 10) with a treatment container 15 and a door 20. Inside the treatment container 15 there may be a device for holding dishes (e.g., a rack 25) and a device for treating items inside the treatment container 15 (e.g., a spray device 30). Any number of racks and spray devices can be included, but only one spray device 30 and two racks 24 are illustrated for simplicity. The spray device 30 is illustrated as a rotary arm, but any type of spray device may be included. The treatment container 15 is thus configured to wash dishes.

Figure 2:
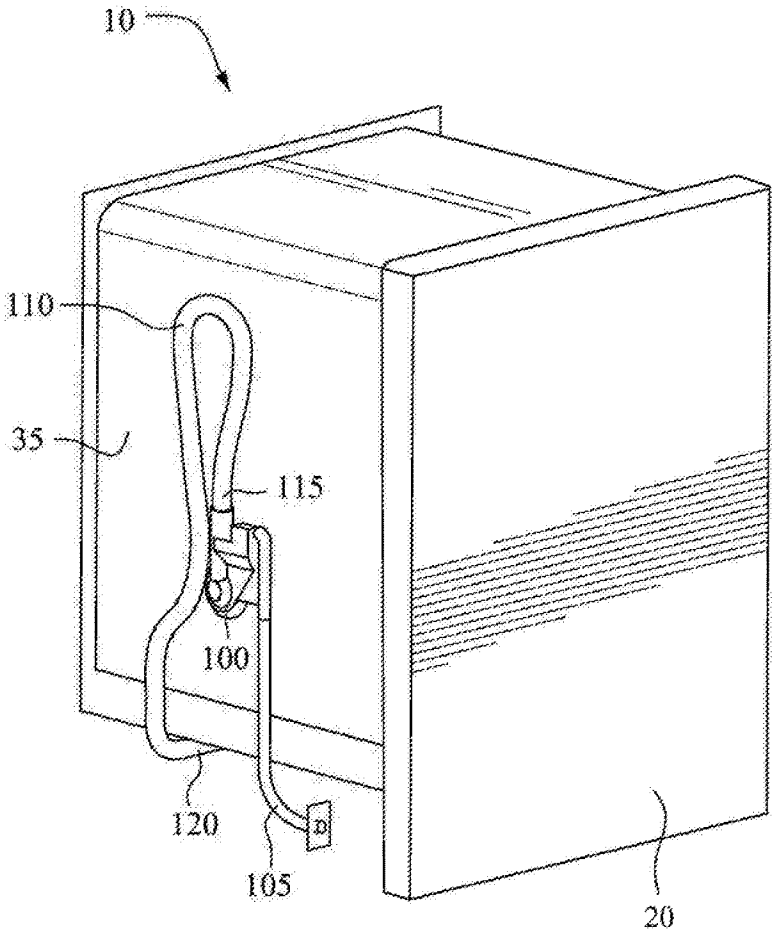
FIG. 2 is a perspective view of a water conducting household appliance with a door in a closed position.

FIG. 2 illustrates the dishwasher 10 from a side perspective view with the door 20 in a closed condition and a water inlet device 100 mounted on an exterior side wall 35. An inlet hose 105 and an expansion hose 110 are connected to the water inlet device 100. A first end 115 of the expansion hose 110 is illustrated as connected to the water inlet device 100. A second end 120 of the expansion hose 110 is open to atmosphere and may be connected to a water collection tray (not illustrated). The water collection tray may be provided to collect any water that may flow out of the second end 120.

Figure 3:
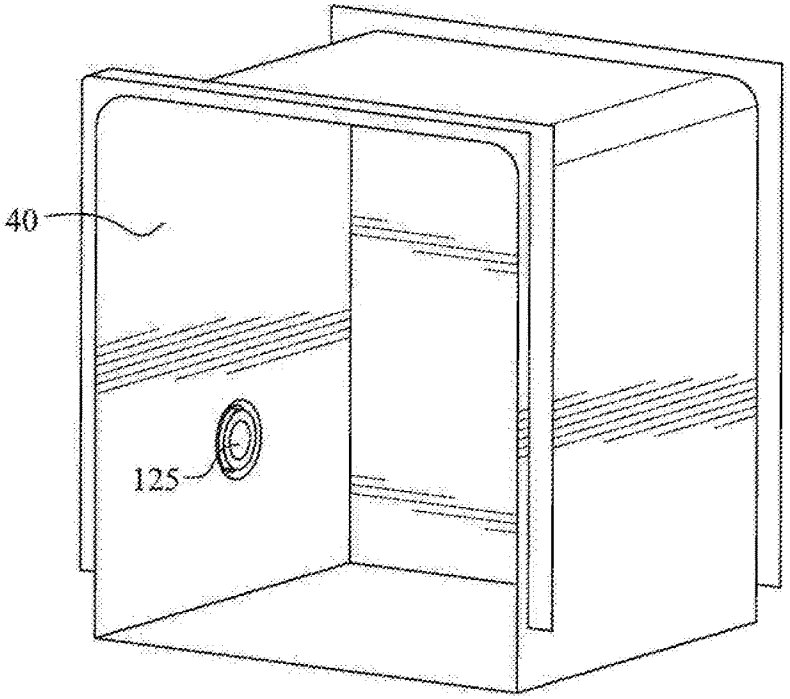
FIG. 3 is a perspective view of a water conducting household appliance with a door and interior components omitted.

FIG. 3 illustrates the dishwasher 10 from another side perspective view where the door 20, rack 25 and spray device 30 are omitted to more clearly view an outlet 125 of the water inlet device 100. The outlet 125 provides fluid communication between the water inlet device 100 and the treatment container 15. The outlet 125 is approximately one-third of the way up an interior wall 40 of the treatment container 15. The outlet 125 may be located at any height that is convenient.

Figure 4:
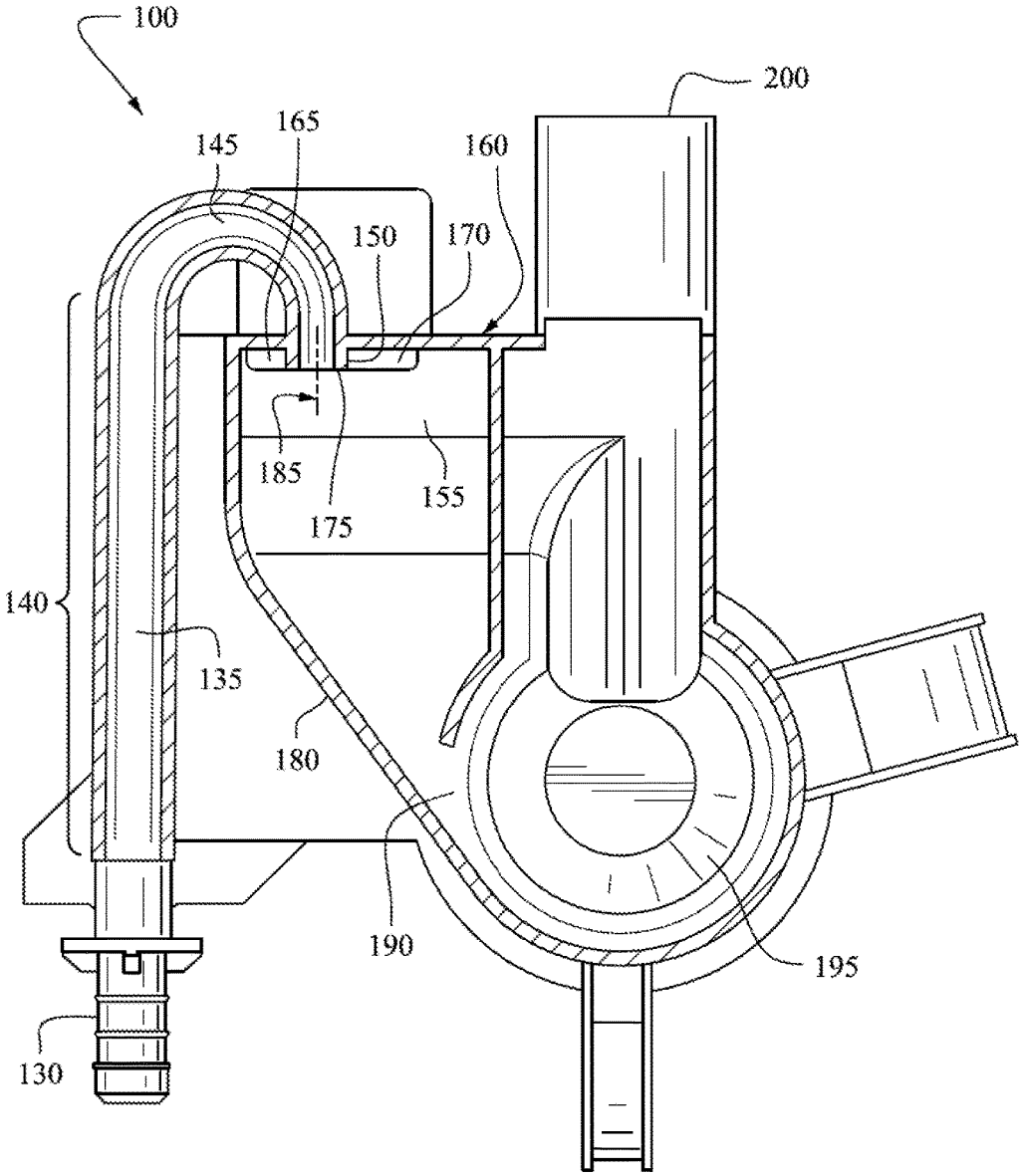
FIG. 4 (RELATED ART)
FIG. 4 is a front view of an inlet device with a cover omitted to view the interior of the inlet device.

FIG. 4 illustrates a related water inlet device 100. The water inlet device 100 is illustrated with a cover removed so that the internal features are visible.

The water inlet device 100 includes a fluid inlet 130 illustrated as a hose barb. Any connection suitable for fluid such as water may be provided. The fluid inlet 130 fluidly connects to a flow passage 135 downstream of the fluid inlet 130. The flow passage 135 extends upwardly and may be substantially vertical along a first section 140, although the first section 140 may be positioned other than vertically. At a top end of the first section 140, the flow passage 135 includes a bend 145. The bend 145 is illustrated as an approximately 180° bend. Other bend angles may be included and may depend on the orientation of the first section 140. Extending from the bend 145 is a conduit 150 extending into a first chamber 155 through a top wall 160 of the first chamber 155. Thus the first chamber 155 is downstream of the flow passage 135. The conduit 150 is illustrated as relatively short, but other relatively longer conduits may be employed. As illustrated, the flow passage 135 is in the form of an inverted "J."

A first vent opening 165 and a second vent opening 170 are illustrated within the first chamber 155. The first vent opening 165 and the second vent opening 170 are illustrated on opposite sides of the conduit 150, with a lowest portion of the vent openings 165, 170 being at the same height as an end 175 of the conduit 150. The conduit 150 may extend lower than a lowest portion of the vent openings 165, 170. As illustrated, the conduit 150 is smaller than a portion of the first chamber 155 immediately surrounding the conduit 150. The vent openings 165, 170 may be located in other locations that tend to prevent water from flowing out of the vent openings 165, 170 but allow communication with atmospheric conditions. Although two vent openings 165, 170 are illustrated, a single vent opening or three or more openings may be provided. When water flows into the first chamber 155, the vent openings 165, 170 control the water pressure to be the same as the surrounding atmosphere. In this way, the first chamber 155 and the vent openings 165, 170 function as a pressure regulating device.

The first chamber 155 includes an angled wall 180 that is angled with respect to a central axis 185 of the end 175. The angled relationship between the angled wall 180 and the central axis 185 may help to reduce noise generated when water enters the first chamber 155. When water impinges at an acute angle, any noise generated may be decreased.

An opening 190 is provided towards a lowest point of the first chamber 155 so that the first chamber 155 is in fluid communication with a second chamber 195 downstream of the first chamber 155. The second chamber 195 may function as an expansion device or expansion chamber. The second chamber 195 is in fluid communication with the outlet 125 (not illustrated in FIG. 4) which provides fluid communication with the treatment container 15 downstream of the second chamber 195. The second chamber 195 is illustrated as substantially circular in cross-section, although any convenient shape may be used.

A condensation port 200 is illustrated as extending upwards substantially vertically, although other orientations are possible. For example, the condensation port 200 could be oriented to form an angle with vertical, e.g., any angle that allows fluid to flow downwards to the second chamber 195. The condensation port 200 is thus downstream of the second chamber 195. The condensation port 200 provides fluid communication with the second chamber 195 and connects with the first end 115 of the expansion hose 110. By way of the outlet 125 and the second chamber 195, steam that forms in the treatment container 15 is allowed to rise upwards into the expansion hose 110, cool, condense and drain back into the treatment container 15. This configuration may prevent excessive pressure from being generated in the treatment container 15.

The vent openings 165, 170 may also allow steam to exit the treatment container 15, but steam exiting at the vent openings 165, 170 may not be desirable.

Figure 5:
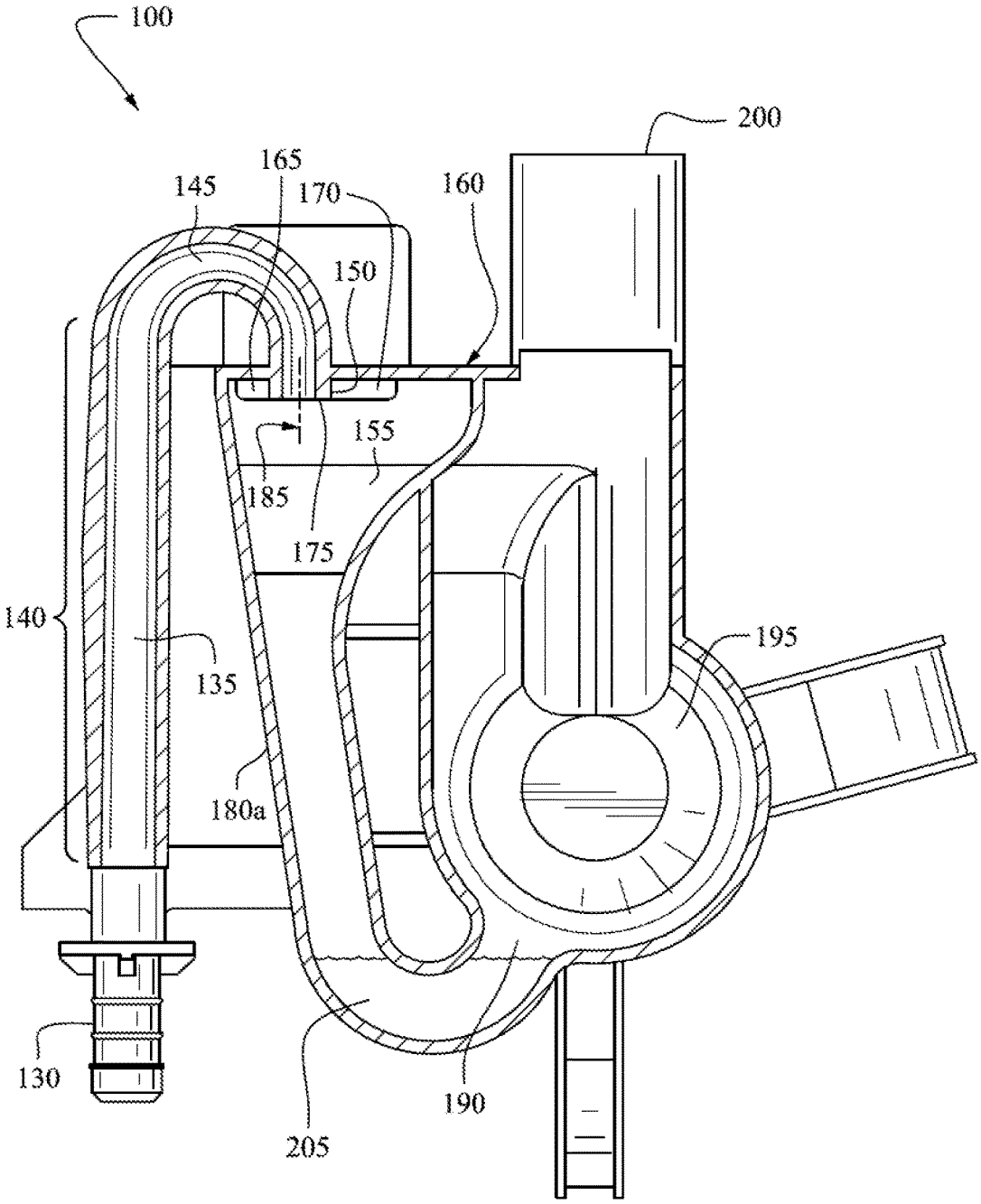
FIG. 5 is a front view of an inlet device with a water trap and with a cover omitted to view the interior of the inlet device.

FIG. 5 is largely similar to FIG. 4, so like reference numbers may be assumed to be the same as described with reference to FIG. 4. FIG. 5 differs from FIG. 4 in two ways.

First, angled wall 180*a* forms a smaller angle with central axis 185. For example, the angled wall 180*a* may form an acute angle that may be 30°, 15°, or less with the central axis 185. As illustrated, the angle is about 10°.

Second, a water trap 205 is illustrated in fluid communication between the first chamber 155 and the second chamber 195. Alternatively, the water trap 205 may be considered a lowest portion of the first chamber 155. Viewed another way, the water trap 205 may be considered to have an inlet, an intermediate flow passage and an outlet downstream of the first chamber 155.

The water trap 205 may act as a seal that prevent steam from exiting through the vent openings 165, 170. When water flows in through the water inlet device 100, a predetermined amount of water remains in the water trap 205. The predetermined amount of water is defined based upon a volume of the water trap that is below a lowest point of the outlet 125. When water is trapped in this manner, the water in the water trap 205 is able to resist pressure generated in the treatment container 15 and prevent steam or other gases from flowing backwards through the water trap 205 and out of the vent openings 165, 170. Due to the condensation port 200 being open to atmospheric conditions by way of the expansion hose 110, the water trap 205 only has to provide resistance to back pressure generated by the amount of pressure drop in the expansion hose 110 in order to prevent steam or other gases from flowing out of the vent openings 165, 170. However, the amount of back pressure may be substantially zero because the only flow through the expansion hose 110 under normal operating conditions should be due to expansion from heating in the treatment container 15, which should be minimal. Gas may also flow outwards through the expansion hose 110 when water flows into the treatment container 15 via the water inlet device 100. However, the water trap 205 may not need to resist back pressure per se in this scenario because water flowing through the trap should overcome any pressure resistance in the expansion hose 110.

The relative locations of the water trap 205 and the angled wall 180*a* may provide for an arrangement that prevents or reduces noise generated by water entering the water inlet device 100. For example, when water impinges on the angled wall 180*a* after exiting the conduit 150, the water may enter the water trap in a relatively quiet manner. If the water impinges on water in the water trap directly instead of on the angled wall 180*a*, splashing may occur that generates more noise than if water impinges on the angled wall 180*a*.

FIGS. 6A, 6B, 6C and 6D illustrate alternate configurations of the water inlet device 100. These alternate configurations are similar to that illustrated in FIG. 5 except for the location of the water trap 205. In each of these figures, the water trap 205 is in a central portion of the first chamber 155. As a result of this location, water entering the first chamber 155 impinges on a second angled wall 210 before flowing through the water trap 205, along the angled wall 180 and through the opening 190.

Figure 6A:
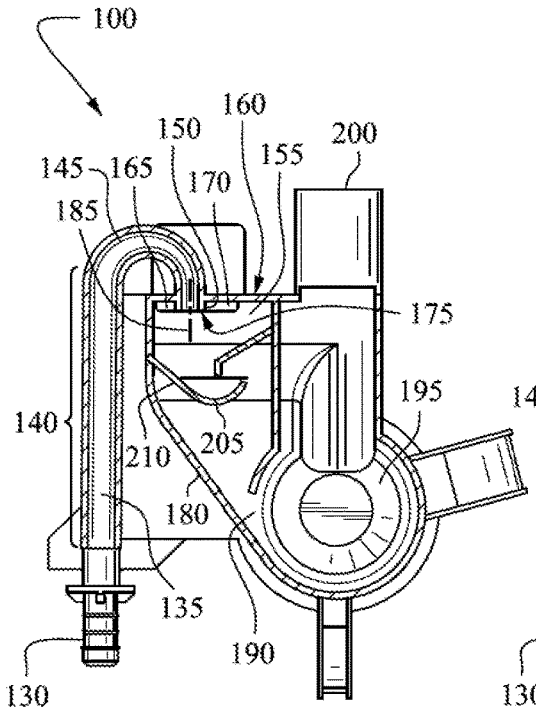
FIG. 6A is a front view of an inlet device with a water trap and with a cover omitted to view the interior of the inlet device.
Figure 6B:
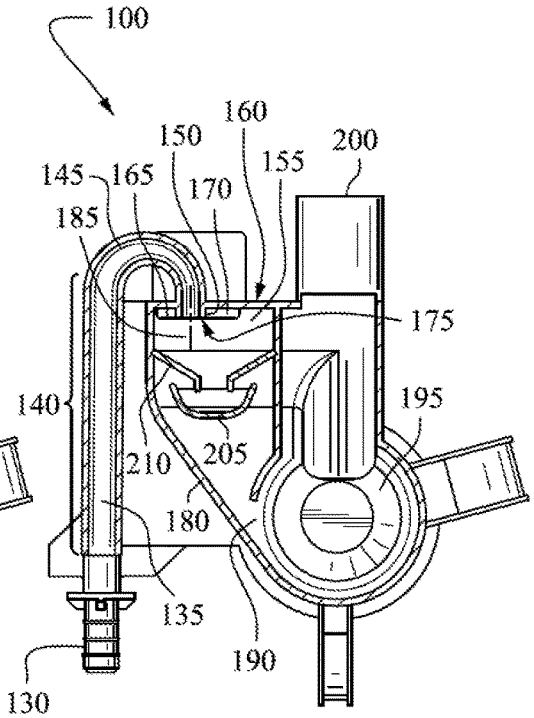
FIG. 6B is a front view of an inlet device with a water trap and with a cover omitted to view the interior of the inlet device.
Figure 6C:
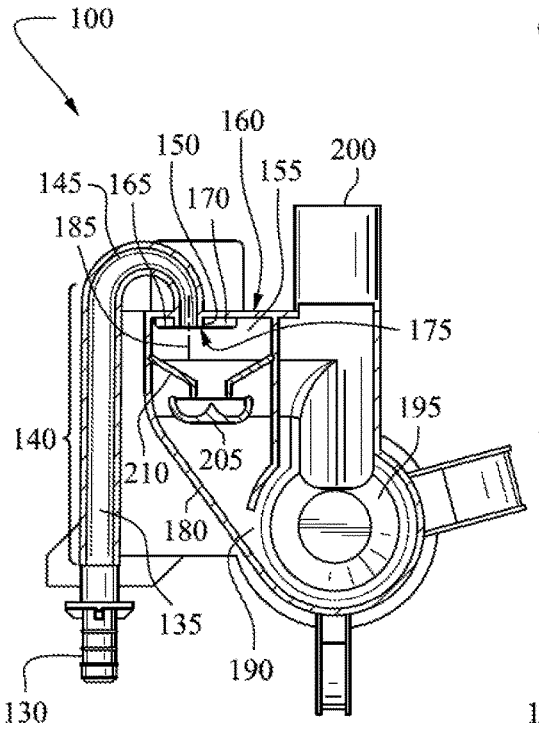
FIG. 6C is a front view of an inlet device with a water trap and with a cover omitted to view the interior of the inlet device.
Figure 6D:
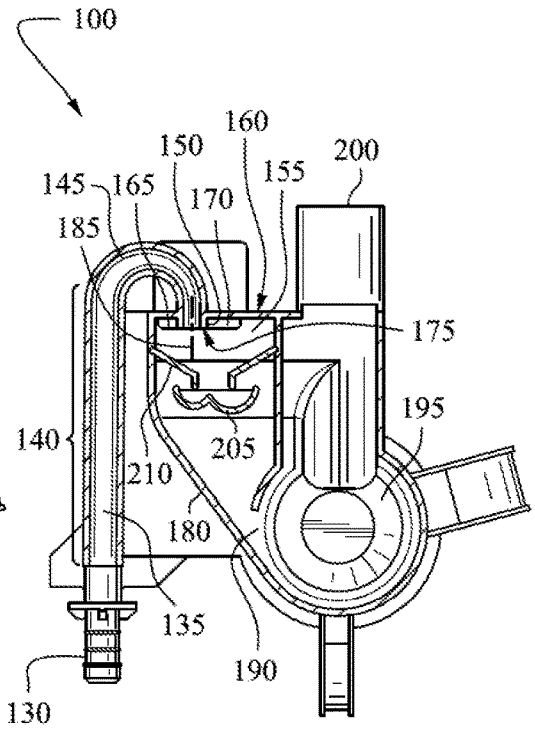
FIG. 6D is a front view of an inlet device with a water trap and with a cover omitted to view the interior of the inlet device.

In FIG. 6A the water trap 205 is similar to that illustrated in FIG. 5 in that the water trap 205 includes only a single outlet. The water trap 205 as illustrated in FIGS. 6B, 6C and 6D has two outlets on the left and right sides, respectively. The water trap 205 illustrated in FIGS. 6C and 6D is further differentiated by a raised portion that effectively creates a water trap for both of the left and right outlets. The configurations illustrated in FIGS. 6A, 6B, 6C and 6D were tested and found to have a lower flow rate capability than that illustrated in FIG. 5, which can accommodate a flow rate of 2.5 liters per minute or more.

Figure 7:
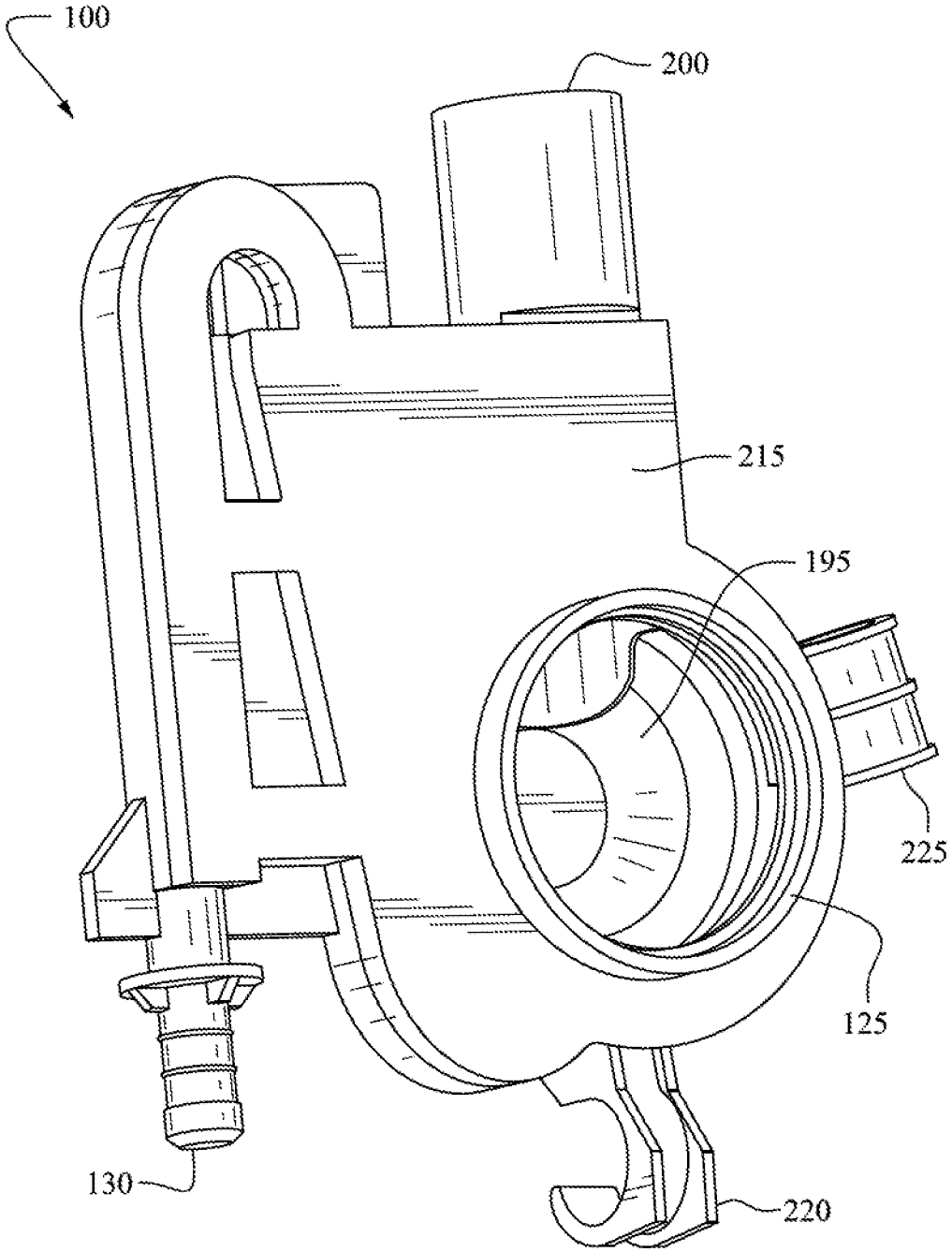
FIG. 7 is a front view of an inlet device with a cover in place.

FIG. 7 illustrates the water inlet device 100 with a cover 215 in place. The cover 215 encloses the various open passages illustrated in FIGS. 4-6D. Alternatively, the water inlet device 100 could be fabricated without the cover 215, i.e. as a single unitary piece with internal flow passages. The number of components used to fabricate the water inlet device 100 should be chosen for convenience and ease of manufacture. The water inlet device 100 could be made out of any number of components and still be within the spirit of the technology described herein.

FIG. 7 also illustrates a first hose support 220 and a second hose support 225. These hose supports may be omitted or included as convenient. For example, the second hose support 225 may support the expansion hose 110 in the configuration illustrated in FIG. 2.

While the present technology has been described in connection with several practical examples, it is to be understood that the technology is not to be limited to the disclosed examples, but on the contrary, is intended to cover various modifications and equivalent arrangements included within the spirit and scope of the technology.

The invention claimed is:

1. A water conducting household appliance comprising:
a water inlet;
a pressure reducer downstream of and in fluid communication with the water inlet;
a water trap downstream of and in fluid communication with the pressure reducer;
an expansion device downstream of and in fluid communication with the water trap;
a treatment container downstream of and in fluid communication with the expansion device; and
a condensation device downstream of and in fluid communication with the expansion device,
wherein the pressure reducer comprises a chamber, and
wherein the chamber is configured so that water entering the chamber from the water inlet impinges on a side wall of the chamber at an acute angle in a range of 10° to 30° before flowing into the water trap to thereby reduce noise generated when water enters the chamber.

2. The water conducting household appliance according to claim 1, wherein the chamber comprises a vent connected to atmosphere.

3. The water conducting household appliance according to claim 2, wherein the chamber comprises:
a top with a flow passage connected to the water inlet; and
a conduit extending downwards from the flow passage to an interior of the chamber, the conduit being smaller than a surrounding portion of the chamber and having an open, unconnected end,
wherein the vent is above the open, unconnected end.

4. The water conducting household appliance according to claim 3, wherein the water trap is below the open, unconnected end.

5. The water conducting household appliance according to claim 4, wherein the condensation device comprises an expansion hose.

6. The water conducting household appliance according to claim 5, wherein the expansion hose extends upwards from the expansion device.

7. The water conducting household appliance according to claim 2, wherein the water trap forms a lowest portion of the chamber.

8. The water conducting household appliance according to claim 1, wherein the acute angle is 10°.

9. The water conducting household appliance according to claim 1, wherein the acute angle is in a range of 10° to 15°.

10. The water conducting household appliance according to claim 1, wherein the treatment container is configured to wash dishes.

11. The water conducting household appliance according to claim 10, wherein the treatment container comprises a rack for the dishes and a spray device to spray the dishes.

12. The water conducting household appliance according to claim 1, wherein the water trap comprises a water trap inlet, a water trap outlet and an intermediate flow passage and the water trap inlet and the water trap outlet are higher than the intermediate flow passage such that when water flows through the water trap a predetermined amount of water remains in the water trap to fill the intermediate flow passage and prevent gas from flowing through the water trap.

13. A water conducting household appliance comprising:
a water inlet;
a pressure reducer downstream of and in fluid communication with the water inlet;
a water trap downstream of and in fluid communication with the pressure reducer;
an expansion device downstream of and in fluid communication with the water trap;
a treatment container downstream of and in fluid communication with the expansion device; and
a condensation device downstream of and in fluid communication with the expansion device,
wherein the pressure reducer comprises a chamber,
wherein the chamber comprises a side wall having a first side wall portion, an angled side wall portion, and an angled wall that protrudes from the first side wall portion, and
wherein the water trap is in a central portion of the chamber, so that water entering the chamber impinges on the angled wall before flowing through the water trap, and then along the angled side wall portion of the side wall.

14. The water conducting household appliance according to claim 13, wherein the water trap is formed as an extension of the angled wall and includes only a single water outlet.

15. The water conducting household appliance according to claim 13, wherein the water trap includes two water outlets.

16. The water conducting household appliance according to claim 15, wherein the water trap includes a raised portion that creates a water trap portion for each of the two water outlets.

17. The water conducting household appliance according to claim 13, wherein the first side wall portion is vertical and the angled side wall portion extends downward from the first side wall portion at an acute angle.

* * * * *